US008236273B2

(12) United States Patent
Oyama et al.

(10) Patent No.: US 8,236,273 B2
(45) Date of Patent: Aug. 7, 2012

(54) METHOD OF PRODUCING PRE-OXIDATION FIBER AND CARBON FIBER

(75) Inventors: Taro Oyama, Sunto-gun (JP); Rie Kawahito, Sunto-gun (JP); Hiroshi Kimura, Sunto-gun (JP)

(73) Assignee: Toho Tenax Co., Ltd., Tokyo (JP)

( * ) Notice: Subject to any disclaimer, the term of this patent is extended or adjusted under 35 U.S.C. 154(b) by 127 days.

(21) Appl. No.: 12/747,386

(22) PCT Filed: Dec. 10, 2008

(86) PCT No.: PCT/JP2008/072381

§ 371 (c)(1),
(2), (4) Date: Jun. 10, 2010

(87) PCT Pub. No.: WO2009/084390

PCT Pub. Date: Jul. 9, 2009

(65) Prior Publication Data

US 2010/0260658 A1 Oct. 14, 2010

(30) Foreign Application Priority Data

Dec. 30, 2007 (JP) ..... 2007-341567

(51) Int. Cl.
*D01F 9/12* (2006.01)

(52) U.S. Cl. ..... 423/447.6; 264/29.6

(58) Field of Classification Search ..... 264/29.6; 423/447.6

See application file for complete search history.

(56) References Cited

U.S. PATENT DOCUMENTS

| | | | |
|---|---|---|---|
| 4,917,836 A | 4/1990 | Yamane et al. | |
| 5,098,688 A | 3/1992 | Schimpf et al. | |
| 7,749,479 B2 * | 7/2010 | Leon y Leon | 423/447.2 |

FOREIGN PATENT DOCUMENTS

| | | |
|---|---|---|
| JP | 63-28132 B2 | 6/1988 |
| JP | 3-23649 B2 | 3/1991 |
| JP | 3-23650 B2 | 3/1991 |
| JP | 05-214614 A | 8/1993 |
| JP | 10-025627 A | 1/1998 |
| JP | 2001-131833 A | 5/2001 |
| JP | 2003-138434 A | 5/2003 |
| JP | 2003-138435 A | 5/2003 |
| JP | 2006-283227 A | 10/2006 |
| JP | 2007-177368 A | 7/2007 |

OTHER PUBLICATIONS

Supplementary European Search Report dated Mar. 17, 2011 issued in a corresponding European Patent Application No. 08868762.9.

* cited by examiner

*Primary Examiner* — Stuart Hendrickson
(74) *Attorney, Agent, or Firm* — Sughrue Mion, PLLC

(57) ABSTRACT

There is disclosed a method of producing a pre-oxidation fiber in the production of the pre-oxidation fiber by subjecting a polyacrylic precursor fiber to pre-oxidation processing in an oxidizing atmosphere, including shrinking the precursor fiber as a pretreatment of pre-oxidation at a load of 0.58 g/tex or less in the temperature range of 220 to 260° C. under conditions in which the degree of cyclization ($I_{1620}/I_{2240}$) of the precursor fiber measured by a Fourier transform infrared spectrophotometer (FT-IR) does not exceed 7%, initially-drawing the precursor fiber at a load of 2.7 to 3.5 g/tex in an oxidizing atmosphere at 230 to 260° C. in the ranges of the degree of cyclization of not exceeding 27% and of the density of not exceeding 1.2 g/cm$^3$, and then subjecting the pre-oxidation fiber to pre-oxidation treatment. A carbon fiber of high strength and high elasticity that is appropriate for composite materials that exhibit high composite performance is obtained by continuously subjecting this pre-oxidation fiber to carbonization treatment.

4 Claims, No Drawings

METHOD OF PRODUCING PRE-OXIDATION FIBER AND CARBON FIBER

CROSS REFERENCE TO RELATED APPLICATIONS

This application is a National Stage of International Application No. PCT/JP2008/072381 filed Dec. 10, 2008, the content of which is incorporated herein by reference in its entirety.

TECHNICAL FIELD

The present invention relates to a method of producing a high strength carbon fiber and a method of producing a pre-oxidation fiber useful as its intermediate.

BACKGROUND ART

Recently, composite materials using a carbon fiber as a reinforced fiber have been frequently used as structural materials of aircraft, etc. due to their excellent mechanical characteristics such as lightness and high strength. These composite materials are molded, for example, from a prepreg, which is an intermediate product, produced by impregnating a reinforced fiber with a matrix resin through molding and processing steps including heating and pressurizing. As such, it is required that optimal materials or molding and processing means for them are adopted for obtaining a desired composite material. In addition, depending on applications, the carbon fiber that is a reinforced fiber may require still higher strength, etc. For example, for lightening of a composite material for aircraft, although elasticity should be increased while maintaining the strength of the carbon fiber, carbon fibers are generally increased in brittleness and decreased in elongation as the elastic modulus is increased, whereby it is difficult to obtain a composite material having high composite performance.

In the aircraft field, carbon fibers with medium strength and elastic modulus, for example, carbon fibers with a strength of about 5,680 MPa and an elastic modulus of about 294 GPa have been conventionally used. However, recently, mainly for lightening of the airframe, composite materials having still higher performance have been required and in response to this carbon fibers having both high strength and high elasticity have been attempted to be developed. However, the elastic modulus and elongation are in trade-off relationship, so that carbon fibers are lowered in elongation and increased in brittleness as the elastic modulus is increased. Hence, it has been extremely difficult to produce a high performance carbon fiber having both high elasticity and high strength as well as hardly lowered physical properties such as brittleness. In particular, this tendency becomes remarkable when the elastic modulus exceeds 294 GPa, whereby the development has been extremely difficult including securement of stable physical properties.

In making the carbon fiber and the matrix resin composite, it is essential to improve also strength, elastic modulus, etc. of the carbon fiber itself as described above to pursue high performance. In addition, the improvement of the intensity and elastic modulus, etc. of the carbon fiber have been conventionally discussed in different ways. In particular, the improvement and modification of a pre-oxidation step and/or carbonization (including graphitization) step for producing carbon fibers from polyacrylic precursor fibers have been aggressively studied even comparatively recently (see, e.g., Patent Documents 1 to 5). However, no industrially advantageous method has been necessarily established of producing a carbon fiber with high strength and high elasticity suitable for a composite material that requires present, particularly high composite performance.

Patent Document 1: Japanese Laid-Open Patent Application No. 5-214614

Patent Document 2: Japanese Laid-Open Patent Application No. 10-25627

Patent Document 3: Japanese Laid-Open Patent Application No. 2001-131833

Patent Document 4: Japanese Laid-Open Patent Application No. 2003-138434

Patent Document 5: Japanese Laid-Open Patent Application No. 2003-138435

In general, as a method for producing a carbon fiber using a polyacrylic precursor fiber is known a method of production that includes oxidizing (fireproof treating) a precursor fiber while drawing or shrinking the precursor fiber at 200 to 280° C. in an oxidation atmosphere and then carbonizing the resultant material at 300° C. or higher in an inert-gas atmosphere. In particular, the method of treating a fiber in the pre-oxidation step greatly affects the strength development of a carbon fiber, and has long been studied in a variety of manners.

Reports have long been made, for example, on obtaining a high strength carbon fiber by carbonizing a pre-oxidation thread having a fiber density of 1.30 to 1.42 g/cm$^3$, produced in a pre-oxidation step in the elongation rate range of −10 to +10% (an elongation rate of 0.9 to 1.1) (see, for example, Patent Document 6), obtaining a high-strength carbon fiber by giving an elongation rate of 3% or more (a draw ratio of 1.03 or more) until the fiber density reaches 1.22 g/cm$^3$, substantially suppressing a subsequent shrinkage and subjecting the resulting fiber to pre-oxidation, and then carbonizing (see Patent Document 7), or obtaining a carbon fiber having a strand strength of 460 kgf/mm$^2$ or more by subjecting a fiber to pre-oxidation with an elongation rate of 3% or more (a draw ratio of 1.03 or more) and further to drawing treatment with an elongation rate of 1% or more (a draw ratio of 1.01 or more) until the fiber density reaches 1.22 g/cm$^3$, and then carbonizing (see Patent Document 8).

Patent Document 6: Japanese Published Examined Application No. 63-28132

Patent Document 7: Japanese Published Examined Application No. 3-23649

Patent Document 8: Japanese Published Examined Application No. 3-23650

DISCLOSURE OF THE INVENTION

Problems to be Solved by the Invention

The subject of the invention is to provide a method of producing a carbon fiber of high strength and high elasticity suitable for a composite material requiring recent, particularly high composite performance.

Means for Solving the Problems

The present inventors have modified a pre-oxidation step and/or carbonization (including graphitization) step from a quite new viewpoint in the method for producing a carbon fiber using a polyacrylic precursor fiber conventionally known as described above to produce a carbon fiber of high strength and high elasticity suitable to a composite material requiring particularly high composite performance, having led to the present invention.

One aspect of the present invention is, in the production of a pre-oxidation fiber by subjecting a polyacrylic precursor fiber to pre-oxidation processing in an oxidizing atmosphere, a method of producing a pre-oxidation fiber that includes (1) shrinking the above precursor fiber as a pretreatment of pre-oxidation at a load of 0.58 g/tex or less in the temperature range of 220 to 260° C. under conditions in which the degree of circulation ($I_{1620}/I_{2240}$) of the precursor fiber measured by a Fourier Transform Infrared Spectrophotometer (FT-IR), (2) initially-drawing the precursor fiber at a load of 2.7 to 3.5 g/tex in an oxidizing atmosphere of 230 to 260° C. in the ranges of the degree of circulation of not exceeding 27% and of the density of not exceeding 1.2 g/cm$^3$, and then (3) subjecting the precursor fiber to pre-oxidation treatment at 200 to 280° C., preferably 240 to 250° C., at a draw ratio of 0.85 to 1.3, preferably 0.95 or more, until the density becomes 1.3 to 1.5 g/cm$^3$.

Another aspect of the present invention is a method of producing a carbon fiber that continuously carbonizes the polyacrylic precursor fiber obtained as described above by a well-known method. Further, carbonization treatment in the present invention includes so-called graphitization treatment.

Still another aspect of the present invention is a carbon fiber itself having a tensile strength of 5880 MPa or more and an elastic modulus of 308 GPa or more, obtained by the method of production described above.

Advantages of the Invention

In the present invention, when the polyacrylic precursor fiber is subjected to pre-oxidation, the moisture in the fiber is discharged and the structure of the fiber is made voidless by shrinking the fiber once as its pretreatment. As a result, a pre-oxidation fiber decreased in internal flaws can be produced. In addition, when this pre-oxidation fiber as an intermediate is subjected to carbonization treatment by a conventionally well-known method, a carbon fiber with high strength and high elasticity can be obtained. If the conditions are appropriately set, a carbon fiber improved in elastic modulus while maintaining high strength, which has a tensile strength of 5880 MPa or more and an elastic modulus of 308 GPa or more, can be obtained. In addition, a composite material obtained from such carbon fiber and matrix resin has excellent composite characteristics, so a composite material having higher performance than conventional ones can be obtained. This can be utilized as a composite material light and suitable to structural material, for example, in the aerospace and automotive fields.

DESCRIPTION OF THE PREFERRED EMBODIMENTS

In the present invention, conventionally well-known polyacrylic fibers can be used without any limitation as polyacrylic precursor fibers used in the method of producing a pre-oxidation fiber or a carbon fiber. Of these, a polyacrylic fiber having an orientation of 90.5% or less by wide angle x-ray diffraction (diffraction angle: 17° is preferred. Specifically, a spinning solution made by a homopolymer or a copolymer containing 90% by weight of acrylonitrile, preferably 95% by weight, is spun to obtain a carbon fiber material (precursor fiber). Although the spinning method can use either a wet spinning process or dry-wet spinning process, a wet spinning process is preferred that can obtain a fiber having a pleat on its surface to obtain a carbon fiber excellent in adhesion properties by an anchor effect with the resin. Moreover, preferably, a fiber obtained by a wet spinning process is then water-washed, dried, and drawn to make a carbon fiber material. Monomers for copolymerization preferably include methyl acrylate, itaconic acid, methyl methacrylate, acrylic acid, and the like.

The polyacrylic precursor fiber obtained in this way can be subjected to pre-oxidation processing according to the method of producing a pre-oxidation fiber of the present invention to obtain a pre-oxidation fiber. In addition, the carbonization of this pre-oxidation fiber (as required, including so-called graphitization treatment) can provide a carbon fiber having high strength and high elasticity.

Usual pre-oxidation of the polyacrylic precursor fiber is performed, for example, in the temperature range of 200 to 280° C., preferably 240 to 250° C., in an oxidizing atmosphere such as heated air. In this case, the precursor fiber is generally drawn or shrunk at a draw ratio of 0.85 to 1.3, more preferably 0.95 or more, to obtain a carbon fiber with high strength and high elasticity. This pre-oxidation provides a pre-oxidation fiber of a fiber density of 1.3 to 1.5 g/cm$^3$ and the tension applied to the yarn in pre-oxidation is not particularly limited.

In the pre-oxidation process, the polyacrylic precursor fiber if not drawn shrinks with the rise of the process temperature. Hence, the draw ratio can be adjusted by adjusting the drawing stress to draw the fiber. A draw ratio of 1.0 indicates that the balance between the shrinkage and drawing is kept and the lengths before and after the drawing are identical to each other though drawing stress is given to the fiber.

The present invention is characterized in that the fiber is first pretreated in the above pre-oxidation. In other words, first, (1) the precursor fiber is shrunk as the pretreatment of pre-oxidation under conditions that the temperature is from 220 to 260° C., preferably 230 to 245° C., the load is 0.58 g/tex or less, preferably 0.55 g/tex or less, and the degree of cyclization ($I_{1620}/I_{2240}$) measured by a Fourier transform infrared spectrophotometer (FT-IR) does not exceed 7%, preferably 6.6% or less. However, when the load is lowered too much, the running thread contacts a slack furnace or heater part to thereby be possibly cut or lower the physical properties due to surface flaws, so that the load is preferably a weight or heavier in which the running thread is not loosen and within the above range.

Further, the degree of cyclization ($I_{1620}/I_{2240}$) of the precursor fiber as measured by a Fourier transform infrared spectrophotometer (FT-IR) in the present invention is a value used as a measure for pre-oxidation reaction, and the degree of the reaction in which a nitrile group appearing in $I_{2240}$ as the pre-oxidation progresses reacts with a naphthyridine ring appearing in $I_{1620}$.

In the present invention, the precursor fiber pretreated like above is then initially-drawn at a load of 2.7 to 3.5 g/tex, preferably 2.8 to 3.0 g/tex in an oxidizing atmosphere at 230 to 260° C., preferably 240 to 250° C., in ranges in which the degree of cyclization of the precursor fiber does not exceed 27% and the density does not exceed 1.2 g/cm$^3$. In this case, if the load is out of this range, there possibly occurs the cutting of the filament in the step, whereby unpreferably the step is unstable and the productivity is worsen.

The precursor fiber pretreated in a step (1) as described above is initially-drawn in a step (2) under the above conditions. In addition, usual pre-oxidation is continuously carried out on the precursor fiber. In other words, (3) the precursor fiber is subjected to pre-oxidation processing in an oxidizing atmosphere at 200 to 280° C., preferably 240 to 250° C., at a draw ratio of 0.85 to 1.3, preferably 0.95 or more, until the density becomes the range of 1.3 to 1.5 g/cm$^3$, to obtain a pre-oxidation fiber.

The pre-oxidation of the polyacrylic precursor fiber is performed, usually in a heating furnace of an ambient gas circulating system while the precursor fiber is drawn or shrunk by passing it between a feed roller and a take-off roller to between which a predetermined load is applied at a plurality of times. In addition, typically, the polyacrylic precursor fiber is treated in a state of a precursor fiber (strand), whereby the strand is preferably converged as much as possible for the stability in the step. In particular, for a thick strand having a filament number of 20,000, the convergence of the strand is preferably maintained by imparting a suitable lubricant thereto.

The densification of a precursor fiber in the step (1) in the present invention is indispensable to the pre-oxidation of the polyacrylic precursor fiber containing moisture. Typically, a fiber without initiation of a pre-oxidation reaction has a sparse structure, so that when heat is applied thereto, the water in the fiber evaporates and is discharged outside the fiber. However, pre-oxidation occurs from the fiber surface, so that when a pre-oxidation reaction starts before the water in the fiber is taken off, the surface structure formed by this pre-oxidation reaction inhibits the discharge of water. The steam insufficiently discharged forms voids in the fiber and becomes structural defects, and therefore the problem is posed that the strength of the resultant pre-oxidation fiber is decreased. Hence, in the present invention, the precursor fiber is shrinked prior to pre-oxidation under certain conditions that the temperature is from 220 to 260° C., the load is 0.58 g/tex or less, and the degree of cyclization ($I_{1620}/I_{2240}$) of the precursor fiber measured by a Fourier transform infrared spectrophotometer (FT-IR) does not exceed 7%. As a result, the precursor fiber is densified to some extent, moisture in the fiber is sufficient removed, and the generation of voids that may become structural defects in the fiber is suppressed.

There was however another problem that densification of the precursor fiber loosened its molecular structure and subsequent pre-oxidation under normal conditions eventually yielded no satisfactory carbon fiber with high strength and elasticity. Hence, in the present invention, it is so devised that in an initial stage of pre-oxidation step, the precursor fiber is initially drawn at a load of 2.7 to 3.5 g/tex in an oxidizing atmosphere at 230 to 260° C. in a range in which the degree of cyclization of the precursor fiber does not exceed 27% and the density does not exceed 1.2 g/cm$^3$. Such means has proven that the above problem can be solved.

Thereafter, successively, in the same pre-oxidation furnace, the precursor fiber is subjected to pre-oxidation processing within the range of typical conditions in an oxidizing atmosphere at 200 to 280° C., preferably 240 to 250° C., at a draw ratio of 0.85 to 1.3, preferably 0.95 or more, until the density becomes the range of 1.3 to 1.5 g/cm$^3$.

The method of the present invention as described above is particularly advantageously applied, in production cost and quality, to the case where the number of filaments is 20,000 or larger, the orientation measured by wide angle x-ray diffraction is 90% or less, and a fiber bundle of polyacrylic carbon fiber precursors contains 20 to 50% by weight of water per unit weight. The pre-oxidation fiber obtained by pre-oxidation processing under the above conditions has the feature that the passage through steps is good and also the orientation is improved structurally by drawing, so that the strength of the carbon fiber obtained by carbonizing this pre-oxidation fiber is increased.

In the present invention, pre-oxidation is carried out in a pre-oxidation furnace of an oxidizing atmosphere including also the initial drawing step. On the other hand, the pretreating step of pre-oxidation is conveniently carried out in a heating furnace other than a pre-oxidation furnace before the lubricant is imparted. However, if a thought is given to steps, for example, the lubricant imparting step is performed outside the heating furnace, the pretreatment step of pre-oxidation and the pre-oxidation can also continuously performed in the same heating furnace (pre-oxidation furnace).

Another aspect of the present invention is a method of producing a carbon fiber, in the production of the carbon fiber by subjecting a polyacrylic precursor fiber to pre-oxidation processing in an oxidizing atmosphere and then the resulting fiber to carbonization treatment in an inert gas atmosphere, including (1) shrinking the precursor fiber as a pretreatment of pre-oxidation at a load of 0.58 g/tex or less in the temperature range of 220 to 260° C. under conditions in which the degree of cyclization ($I_{1620}/I_{2240}$) of the precursor fiber measured by a Fourier transform infrared spectrophotometer (FT-IR) does not exceed 7%, (2) initially-drawing the precursor fiber at a load of 2.7 to 3.5 g/tex in an oxidizing atmosphere of 230 to 260° C. in the ranges of the degree of cyclization of not exceeding 27% and of the density of not exceeding 1.2 g/cm$^3$, and then (3) subjecting the precursor fiber to pre-oxidation treatment at 200 to 280° C., preferably 240 to 250° C., in an oxidizing atmosphere at a draw ratio of 0.85 to 1.3, preferably 0.95 or more, until the density becomes 1.3 to 1.5 g/cm$^3$, and then subjecting the resulting fiber to carbonization treatment.

In the above invention, the condition and the means for subjecting a polyacrylic precursor fiber to pre-oxidation in an oxidizing atmosphere are shown in the method of producing the pre-oxidation fiber as described above. Such pre-oxidation fiber is then subjected to carbonization treatment to obtain the carbon fiber of the present invention.

When a pre-oxidation fiber is carbonized to obtain a carbon fiber, typically, carbonization treatment is performed as described below, the carbonization treatment in the present invention means such treatment.

[Primary Carbonization Treatment]

In a primary carbonization treatment step, a pre-oxidation fiber is subjected to primary and secondary drawing treatments in an inert atmosphere at a temperature in the range of 300 to 900° C., preferably 300 to 550° C. In other words, first, the pre-oxidation fiber is subjected to the primary drawing treatment at a draw ratio of 1.03 to 1.07, and then to the secondary drawing treatment at a draw ratio of 0.9 to 1.01 to obtain a primary carbonization treatment fiber having a fiber density of 1.4 to 1.7 g/cm$^3$. In the primary carbonization treatment step, the primary drawing treatment preferably carries out drawing treatment at a draw ratio of 1.03 to 1.07 in ranges in which a point where the elastic modulus of the pre-oxidation fiber decreased to a minimum value is increased to 9.8 GPa, and in which the density of the fiber reaches 1.5 g/cm$^3$. In the secondary drawing treatment, the pre-oxidation fiber is preferably subjected to drawing treatment at a draw ratio of 0.9 to 1.01 in a range in which the density of the fiber continues to increase during the secondary drawing treatment after the primary drawing treatment. The adoption of such conditions can make the fiber densified without the growth of the crystal, suppress the growth of voids as well, and finally provide a high strength carbon fiber having a high denseness. The above primary carbonization treatment step can continuously or separately treat the fiber in one furnace or two or more furnaces.

[Secondary Carbonization Treatment]

In a secondary carbonization treatment step, the above primary carbonization treatment fiber is subjected to primary and secondary drawing treatments separately in an inert atmosphere at a temperature in the range of 800 to 2,100° C., preferably 1,000 to 1,450° C. In the primary treatment, the fiber is preferably subjected to drawing treatment in ranges in which the density of the primary carbonization treatment fiber is continuously increased during the primary treatment and in which the nitrogen content of the fiber is 10% by weight. In the secondary treatment, the fiber is preferably subjected to drawing treatment in a range in which the density of the primary treatment fiber is not changed or is lowered. The elongation of the secondary carbonization treatment fiber is preferably 2.0% or more, more preferably 2.2% or more. Moreover, the diameter of the secondary carbonization treatment fiber is preferably from 5 to 6.5 micrometers. In addition, the calcination steps can be carried out in a single facility continuously or in several facilities continuously as well, and are not limited.

[Tertiary Carbonization Treatment]

In the tertiary carbonization treatment step, the above secondary carbonization treatment fiber is further subjected to carbonization or graphitization at 1,500 to 2,100° C., preferably 1,550 to 1,900° C.

[Surface Treatment]

The above tertiary carbonization treatment fiber is sequentially subjected to surface treatment. For surface treatment, vapor phase and liquid phase treatments can be used, and surface treatment by electrolytic treatment is preferred from the viewpoints of simplicity and productivity in step control. Moreover, an electrolyte solution used for electrolytic treatment is not particularly limited, and conventionally well-known inorganic acids, organic acids, alkalis or solutions of their salts can be used. Specifically, the examples include nitric acid, ammonium nitrate, sulfuric acid, ammonium sulfate, sodium hydroxide, and the like.

[Sizing Treatment]

The above surface-treated fiber is sequentially subjected to sizing treatment. The sizing method can be carried out by conventionally well-known methods, and a sizing agent is preferably properly changed in its composition for use in conformity with applications, and uniformly adhered and then dried.

When a carbon fiber is manufactured by the method described above, the carbon fiber of the present invention having a tensile strength of 5,880 MPa or more and an elastic modulus of 308 GPa or more can be obtained.

EXAMPLE

The present invention will be set forth specifically by way of Examples and Comparative Examples. Various physical properties of pre-oxidation fibers and carbon fibers obtained in Examples and Comparative Examples were measured by the following methods.

The degree of cyclization ($I_{1620}/I_{2240}$) was evaluated from the ratio of the peak intensity of the naphthyridine ring appearing at $I_{1620}$ to the peak intensity of the nitrile group appearing at $I_{2240}$ by measuring by the KBr method using Magna-IR•550 available from Thermo Fisher Scientific K.K. The densities of the fibers were measured by deairing treatment of them in acetone by the liquid replacement method (JIS•R•7601).

The resin impregnated strand intensity and the elastic modulus of the carbon fiber were measured by the method specified by JIS•R•7601. The sizing agent of the carbon fiber was removed using acetone by the Soxhlet treatment for three hours and then the fiber was air-dried.

Examples 1 to 3, and Comparative Examples 1 to 9

A copolymer dope comprising 95% by weight of acrylonitrile/4% by weight of methyl acrylate/1% by weight of itaconic acid was subjected to wet spinning by the common procedure, to water washing, oiling and drying and then to steam drawing such that the total draw ratio is 14 to obtain a precursor fiber having a fineness of 1733 tex and a number of filaments of 24,000. The precursor fiber thus obtained was treated by the producing step described below to obtain the pre-oxidation fiber of the present invention.

Step (1): The above precursor fiber was pretreated in a pretreatment furnace as the pretreatment of pre-oxidation in the temperature range of 230 to 245° C. by changing the load under the conditions depicted in Table 1. The degrees of cyclization ($I_{1620}/I_{2240}$) of the precursor fiber measured by a Fourier transform infrared spectrophotometer (FT-IR) were shown in Table 1.

Step (2): The precursor fiber pretreated as described above was initially drawn by changing the load under the drawing conditions as shown in Table 1 until the specific gravity was 1.20 using a circulating hot air pre-oxidation furnace set at 240 to 250° C. The degrees of cyclization of resulting fibers were shown in Table 1.

Step (3): The initially drawn precursor fiber was continuously pre-oxidation processed in the same pre-oxidation furnace in an oxidizing atmosphere set at 240 to 250° C. in the draw ratio range of 1.0 to 1.01 as shown in Table 1 until the density was in the range of 1.3 to 1.5 g/cm$^3$.

Various pre-oxidation fibers obtained above were primarily carbonized in a nitrogen atmosphere at a draw ratio of 1.01 in the furnace temperature distribution of 300 to 580° C. and then secondarily carbonized in the temperature range of 1,000 to 1,450° C. In addition, the resulting secondary carbonization fiber was tertiarily carbonized in the temperature range of 1,400 to 1,850° C., surface treated, sizing treated to thereby obtain carbon fibers having physical properties (strand performance) shown in Table 2.

Table 1 shows that the carbon fibers in Examples 1 to 3 within the range of producing conditions specified in the present invention exhibit more excellent strengths and elastic moduli than Comparative Examples 1 to 9 the physical properties of which do not satisfy all the requirements. In addition, Comparative Examples 1 to 4 and 6 do not satisfy the requirement of the invention that the load (tension) in step (1) should be 0.58 g/tex or less. Comparative Example 5 does not satisfy either the requirement that the load in step (1) should be 0.58 g/tex or less or that initial drawing should be carried out when the load in step (2) is 2.7 to 3.5 g/tex. Comparative Examples 7 and 8 do not satisfy the requirement that initial drawing should be carried out when the load in step (2) is 2.7 to 3.5 g/tex. Comparative Example 9 does not satisfy either the requirement that the load in step (2) is 2.7 to 3.5 g/tex or that the density should not exceed 1.2 g/cm$^3$.

TABLE 1

| | Draw ratio (times) | | | Tension (g/tex) | | Degree of circulation $I_{1620}/I_{2240}$(%) | | Density (g/cm$^3$) | |
|---|---|---|---|---|---|---|---|---|---|
| | Step (1) | Step (2) | Step (3) | Step (1) | Step (2) | Step (1) | Step (2) | Step (2) | Step (3) |
| Example 1 | 0.93 | 1.12 | 1.006 | 0.31 | 2.80 | 3.0 | 25.9 | 1.19 | 1.36 |
| Example 2 | 1.95 | 1.12 | 1.006 | 0.55 | 2.85 | 3.1 | 26.1 | 1.19 | 1.35 |
| Example 3 | 1.95 | 1.12 | 1.005 | 0.55 | 2.90 | 3.1 | 25.9 | 1.19 | 1.37 |
| Comparative Example 1 | 1.00 | 1.05 | 1.006 | 1.29 | 2.80 | 2.6 | 26.5 | 1.19 | 1.37 |
| Comparative Example 2 | 0.99 | 1.06 | 1.006 | 1.14 | 2.83 | 2.7 | 26.5 | 1.19 | 1.38 |
| Comparative Example 3 | 0.98 | 1.07 | 1.006 | 1.01 | 2.83 | 2.7 | 26.3 | 1.19 | 1.36 |
| Comparative Example 4 | 0.97 | 1.08 | 1.006 | 0.83 | 2.81 | 2.8 | 26.1 | 1.19 | 1.37 |
| Comparative Example 5 | 1.01 | 1.05 | 1 | 1.82 | 2.17 | 2.6 | 26.0 | 1.19 | 1.37 |
| Comparative Example 6 | 0.97 | 1.08 | 1.005 | 0.88 | 2.72 | 2.7 | 25.9 | 1.19 | 1.36 |
| Comparative Example 7 | 0.95 | 1.09 | 1.005 | 0.55 | 2.68 | 3.0 | 27.0 | 1.20 | 1.36 |
| Comparative Example 8 | 0.95 | 1.09 | 1.006 | 0.58 | 2.69 | 3.0 | 27.0 | 1.20 | 1.36 |
| Comparative Example 9 | 0.95 | 1.17 | 1.01 | 0.58 | 3.60 | 3.0 | 30.0 | 1.21 | 1.40 |

TABLE 2

| | Strand performance | | | |
|---|---|---|---|---|
| | Strength (MPa) | Elastic modulus (GPa) | Strand (tex) | Specific gravity |
| Example 1 | 5979 | 314 | 832 | 1.77 |
| Example 2 | 5998 | 312 | 821 | 1.78 |
| Example 3 | 5978 | 314 | 816 | 1.77 |
| Comparative Example 1 | 5655 | 310 | 835 | 1.77 |
| Comparative Example 2 | 5635 | 308 | 837 | 1.77 |
| Comparative Example 3 | 5615 | 311 | 828 | 1.77 |
| Comparative Example 4 | 5615 | 314 | 831 | 1.77 |
| Comparative Example 5 | 5272 | 319 | 828 | 1.77 |
| Comparative Example 6 | 5625 | 322 | 840 | 1.77 |
| Comparative Example 7 | 5800 | 314 | 835 | 1.77 |
| Comparative Example 8 | 5735 | 314 | 835 | 1.77 |
| Comparative Example 9 | Non-measurable | Non-measurable | Non-measurable | Non-measurable |

INDUSTRIAL APPLICABILITY

According to the method of production of the present invention, for example, a high-strength, high elasticity carbon fiber having a tensile strength of 5,880 MPa or more and an elastic modulus of 308 GPa or more, can be obtained. In addition, such high-strength, high elasticity carbon fiber is suitable for producing a composite material that has high composite performance demanded for aircraft, etc. Moreover, the inventive pre-oxidation fiber is useful as an intermediate for producing high-strength, high elasticity carbon fiber as described above.

The invention claimed is:

1. A method of producing a pre-oxidation fiber in the production of the pre-oxidation fiber by subjecting a polyacrylic precursor fiber to pre-oxidation processing in an oxidizing atmosphere, the method comprising:

(1) shrinking the precursor fiber as a pretreatment of pre-oxidation at a load of 0.58 g/tex or less in the temperature range of 220 to 260° C. under conditions in which the degree of cyclization ($I_{1620}/I_{2240}$) of the precursor fiber measured by a Fourier transform infrared spectrophotometer (FT-IR) does not exceed 7%, (2) initially-drawing the precursor fiber at a load of 2.7 to 3.5 g/tex in an oxidizing atmosphere of 230 to 260° C. in the ranges of the degree of cyclization of not exceeding 27% and of the density of not exceeding 1.2 g/cm$^3$, and then (3) subjecting the precursor fiber to pre-oxidation treatment at 200 to 280° C. at a draw ratio of 0.85 to 1.3 until the density becomes 1.3 to 1.5 g/cm$^3$.

2. The method of producing the pre-oxidation fiber according to claim 1, wherein the polyacrylic precursor fiber has a number of filaments of 20,000 or larger, an orientation measured by wide angle x-ray diffraction of 90% or less, and is a fiber bundle of polyacrylic carbon fiber precursors containing 20 to 50% by weight of water per unit weight.

3. A method of producing a carbon fiber in the production of the carbon fiber by subjecting a polyacrylic precursor fiber to pre-oxidation processing in an oxidizing atmosphere and then the resulting fiber to carbonization treatment in an inert gas atmosphere, the method comprising:

(1) shrinking the precursor fiber as a pretreatment of pre-oxidation at a load of 0.58 g/tex or less in the temperature range of 220 to 260° C. under conditions in which the degree of cyclization ($I_{1620}/I_{2240}$) of the precursor fiber measured by a Fourier transform infrared spectrophotometer (FT-IR) does not exceed 7%, (2) initially-drawing the precursor fiber at a load of 2.7 to 3.5 g/tex in an oxidizing atmosphere at 230 to 260° C. in the ranges of the degree of cyclization of not exceeding 27% and of the density of not exceeding 1.2 g/cm$^3$, and then (3) subjecting the precursor fiber to pre-oxidation treatment at 200 to 280° C. at a draw ratio of 0.85 to 1.3 in an oxidizing atmosphere, until the density becomes 1.3 to 1.5 g/cm$^3$, and then subjecting the resulting fiber to carbonization treatment.

4. The method of producing the carbon fiber according to claim 3, wherein the polyacrylic precursor fiber has a number of filaments of 20,000 or larger, an orientation measured by wide angle x-ray diffraction of 90% or less, and is a fiber bundle of polyacrylic carbon fiber precursors containing 20 to 50% by weight of water per unit weight.

* * * * *